US010337356B2

(12) United States Patent
Dhima et al.

(10) Patent No.: US 10,337,356 B2
(45) Date of Patent: Jul. 2, 2019

(54) STEAM POWER INSTALLATION COMPRISING VALVE-STEM LEAKAGE STEAM LINE

(71) Applicant: Siemens Aktiengesellschaft, Munich (DE)

(72) Inventors: Rachid Dhima, Essen (DE); Kakhi Naskidashvili, Mülheim an der Ruhr (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 217 days.

(21) Appl. No.: 15/123,748

(22) PCT Filed: Mar. 3, 2015

(86) PCT No.: PCT/EP2015/054355

§ 371 (c)(1),
(2) Date: Sep. 6, 2016

(87) PCT Pub. No.: WO2015/135791

PCT Pub. Date: Sep. 17, 2015

(65) Prior Publication Data

US 2017/0016351 A1 Jan. 19, 2017

(30) Foreign Application Priority Data

Mar. 13, 2014 (EP) ..... 14159494

(51) Int. Cl.
*F01K 3/00* (2006.01)

(52) U.S. Cl.
CPC ..... *F01K 3/00* (2013.01)

(58) Field of Classification Search
CPC . F01K 3/00; F01K 23/106; F01K 7/00; F02C 6/18; F01D 1/023; F01D 17/00
See application file for complete search history.

(56) References Cited

U.S. PATENT DOCUMENTS 4,744,723 A * 5/1988 Hashimoto ..... F01K 7/24 415/1
4,873,827 A * 10/1989 Hadano ..... F01K 7/22 60/646
5,018,356 A 5/1991 Silvestri, Jr. et al.
(Continued)

FOREIGN PATENT DOCUMENTS

CA 2034844 A1 7/1991
DE 102012213976 A1 2/2014
(Continued)

OTHER PUBLICATIONS

English Translation JP 07-071206 A.*
(Continued)

*Primary Examiner* — Mark A Laurenzi
*Assistant Examiner* — Shafiq Mian
(74) *Attorney, Agent, or Firm* — Beusse Wolter Sanks & Maire

(57) ABSTRACT

A steam power installation has a steam turbine and a valve-stem leakage steam line. A fitting is arranged in the valve-stem leakage steam line, which fitting is used to conduct the valve-stem leakage steam into a suitable valve-stem leakage steam collector, such as into a condenser.

10 Claims, 1 Drawing Sheet

(56) References Cited

U.S. PATENT DOCUMENTS

| | | | | |
|---|---|---|---|---|
| 5,727,377 | A * | 3/1998 | Fetescu | F01K 21/042 60/39.3 |
| 7,028,479 | B2 * | 4/2006 | Gobrecht | F01D 19/02 60/646 |
| 8,776,520 | B2 * | 7/2014 | Beul | F01K 7/025 60/645 |
| 9,631,520 | B2 * | 4/2017 | Majumdar | F01K 7/06 |
| 2004/0003593 | A1 | 1/2004 | Sauer et al. | |
| 2011/0214426 | A1 * | 9/2011 | Mehra | F01D 11/06 60/645 |
| 2012/0027565 | A1 | 2/2012 | Maruthamuthu et al. | |

FOREIGN PATENT DOCUMENTS

| | | | | |
|---|---|---|---|---|
| JP | S58206809 | A | | 12/1983 |
| JP | S58217705 | A | | 12/1983 |
| JP | S60237101 | A | | 11/1985 |
| JP | H0771206 | A | | 3/1995 |
| JP | 2001227303 | A | * | 8/2001 |
| JP | 2008089283 | A | * | 4/2008 |

OTHER PUBLICATIONS

English Translation JP 2008089283 A.*

JP 2001227303 A English Translation.*

EP Search Report, dated Aug. 28, 2014, for EP application No. 14159494.5.

International Search Report, dated May 11, 2015, for PCT application No. PCT/EP2015/054355.

JP Office Action dated Aug. 14, 2017, for JP patent application No. 2016-556966.

CN Office Action dated Mar. 28, 2017, for CN patent application No. 201580013099.1.

* cited by examiner

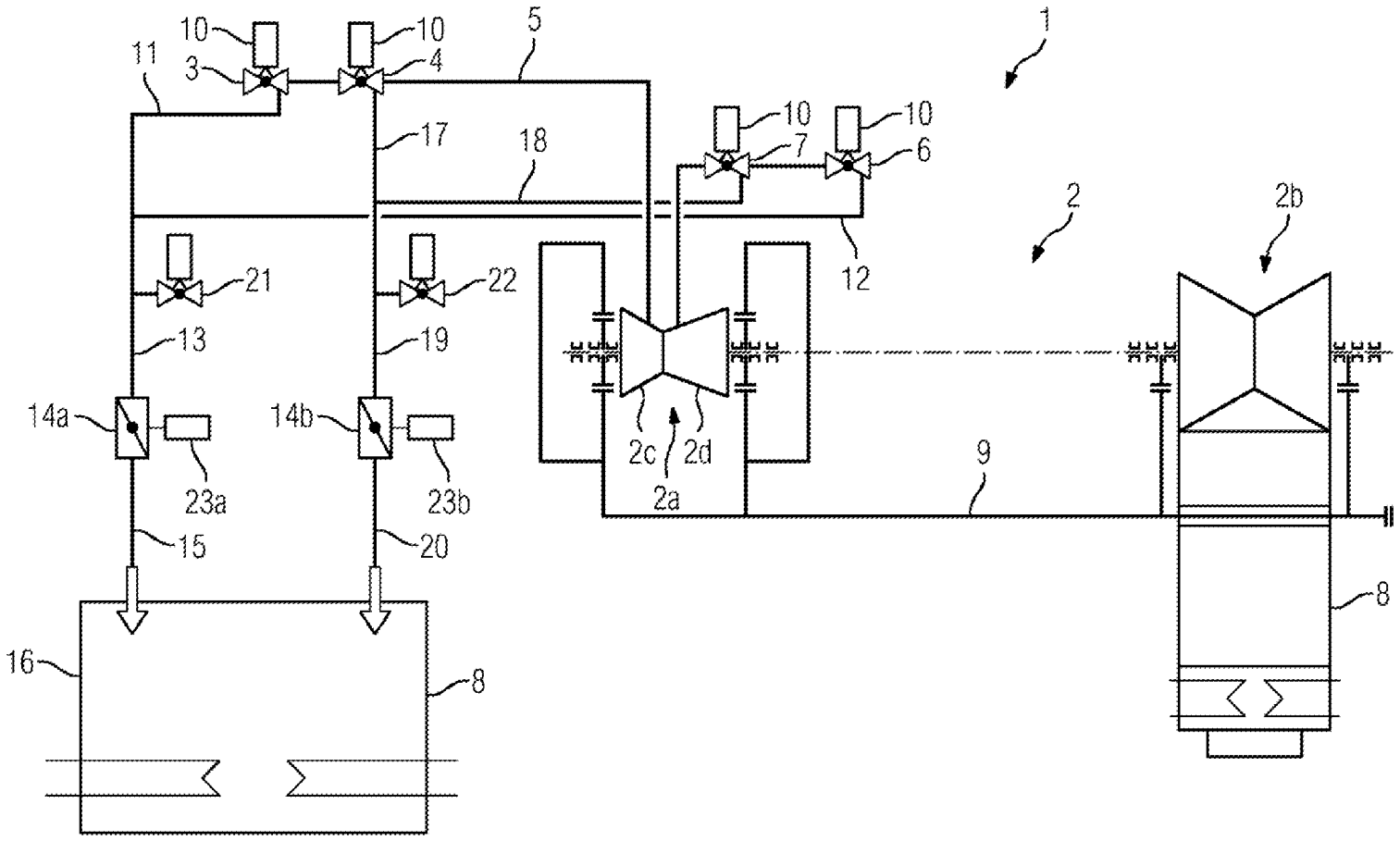
1
2
2b
8
9
10
6
12
10
7
2d
2a
2c
5
18
22
10
4
17
19
23b
20
8
14b
10
3
21
11
13
23a
15
14a
16

STEAM POWER INSTALLATION COMPRISING VALVE-STEM LEAKAGE STEAM LINE

CROSS REFERENCE TO RELATED APPLICATIONS

This application is the US National Stage of International Application No. PCT/EP2015/054355 filed Mar. 3, 2015, and claims the benefit thereof. The International Application claims the benefit of European Application No. EP14159494 filed Mar. 13, 2014. All of the applications are incorporated by reference herein in their entirety.

FIELD OF INVENTION

The invention relates to a steam power plant comprising a steam turbine, a steam line that is fluidically connected to the steam turbine and is designed to convey steam, a valve that is arranged in the steam line and is designed to change a quantity of steam flowing through the steam line, wherein, in operation, valve-stem leakage steam arises in the valve and is fluidically connected to a valve-stem leakage steam line, and a valve-stem leakage steam collector that is fluidically connected to the valve-stem leakage steam line.

The invention also relates to a method for operating a steam power plant.

BACKGROUND OF INVENTION

Steam power plants generally comprise a steam turbine and a boiler, wherein a steam line is designed and arranged such that steam generated in the boiler can flow to the steam turbine. The boiler can produce steam with a temperature of greater than 600° C. and a pressure of greater than 300 bar. Such high steam temperatures and pressures present a challenge to the valves arranged in the steam lines. In general, two valves, specifically a quick-closing valve and a control valve, are arranged in a steam line in which steam is conveyed to a steam turbine. The quick-closing valve is provided for quick closing in the event of a fault and is accordingly designed for this case. The control valve takes on the task of regulating or controlling the supply of steam through the steam line when the quick-closing valve is open.

In modern steam power plants, both quick-closing valves and control valves consist essentially of a valve housing and a valve cone, wherein the valve cone is able to move, by means of a valve stem, in one direction. Steam can flow between the valve stem and the valve housing, wherein this flow is a leakage flow and is therefore termed valve-stem leakage steam. The valve-stem leakage steam is generally collected and supplied to the steam power plant as seal steam.

The high temperatures and high pressures of the steam meant that, hitherto, no other use was possible. Introducing the valve-stem leakage steam for example directly into a condenser would not be possible since, under certain operating conditions, air is drawn into the valve and could therefore lead to possible damage in the valve.

SUMMARY OF INVENTION

The invention aims to provide a remedy here and has addressed the problem of specifying a steam power plant in which the valve-stem leakage steam can be reused.

This object is achieved with a steam power plant comprising a steam turbine, a steam line for conveying steam, a valve that is arranged in the steam line, a valve-stem leakage steam line that is fluidically connected to the valve and a valve-stem leakage steam collector that is fluidically connected to the valve-stem leakage steam line, wherein the valve-stem leakage steam collector is designed as a condenser.

The object is also achieved by proposing a method for operating the steam power plant, in which the fitting opens when valve-stem leakage steam is present upstream of the fitting and closes again when no valve-stem leakage steam flows from the valve.

The invention thus proposes arranging a fitting in the valve-stem leakage steam line. Under operating conditions in which the valve-stem leakage steam flows through the valve-stem leakage steam line, the fitting remains open. In order to avoid backflow under certain operating conditions, the fitting closes when the flow of valve-stem leakage steam ceases. Such operating conditions should be detected by means of suitable measuring devices that are arranged in the valve-stem leakage steam line, upstream of the fitting. Suitable measurement apparatus would for example be a measuring device for detecting the pressure of the valve-stem leakage steam and/or a measuring device for detecting the temperature of the valve-stem leakage steam.

The arrangement of the fitting now makes it possible to envisage targeted use of the valve-stem leakage steam in a larger range of application. This results in the advantage of greater operational reliability.

Hitherto, the valve-stem leakage steam lines were generally fluidically connected to shaft seal systems of the steam turbine. Since the valve-stem leakage steam flows out of the valves—such as the live steam quick-closing valve, the live steam control valve and the reheat quick-closing valve and the reheat control valve—at high temperatures, the entire shaft seal steam system has to be configured for this high temperature, which makes the system expensive. With the invention, the entire shaft seal steam system is thus more cost-effective since it is now possible to use less costly pipeline materials.

It is also possible to use less costly materials for the leakage steam regulating valve and the leakage steam bypass valve.

The valve-stem leakage steam collector is designed as a condenser. Hitherto, it was not possible to introduce the valve-stem leakage steam directly into the condenser. By virtue of the inventive use of a fitting in the valve-stem leakage steam line, it is now possible to convey the valve-stem leakage steam directly into the condenser.

In one advantageous development, the valve-stem leakage steam collector can be designed as a standpipe. A standpipe is generally a water level regulating vessel that is arranged upstream of a condenser. According to the invention, the valve-stem leakage steam is conveyed directly into the standpipe. In the standpipe, which is substantially curved, the steam is introduced in a geodetically lowermost point, whereupon the steam flows upward and finally reaches the condenser, possibly via a water injection means. In the event that the valve-stem leakage steam condenses in the standpipe, the water collected at a geodetically lowermost point is conveyed to the condenser hotwell via a water loop.

Advantageous developments are specified in the dependent claims.

Thus, in a first advantageous development, the fitting is designed as a flap. In this context, in the steam line the fitting is designed with a flap as known in the prior art. Movement of the flap regulates the flow through the valve-stem leakage steam line. A flap is a relatively cost-effective option for regulating the flow of steam through a line.

To that end, in another advantageous development, the flap is designed such that it is controlled. That means that the flap is moved by a control unit to which the control or regulating variables are supplied such that it can be operated from outside. This extends the range of application of the flap.

In another advantageous development, the flap is designed as a check flap.

It is thus possible, in the event of an error or a fault, to prevent an undesired return flow of the valve-stem leakage steam to the valves. This makes it possible to prevent damage to the valves in such a case of a fault or an incident.

Advantageously, the fitting can be designed as a valve. A valve allows more precise regulation of the flow through the valve-stem leakage steam line and can be envisaged depending on the desired field of application. Actuation of the valve can equally be performed by a control unit. To that end, the control unit is pre-programmed with regulating variables from outside. In that context, the control unit can be designed so as to be able to perform autonomous regulation.

In one advantageous development, there is arranged in the valve-stem leakage steam line a safety valve which is arranged in addition to the fitting and which opens if the maximum permitted pressure is exceeded, and protects the valves from high backpressures.

The object is also achieved, according to the invention, by specifying a method for operating the steam power plant, wherein the fitting opens when valve-stem leakage steam is present upstream of the fitting and closes again when no valve-stem leakage steam flows from the valve. This effectively prevents undesired aspiration of air into the valve.

In another advantageous development of the method, the safety valve is opened as soon as a maximum pressure in the valve-stem leakage steam line is reached, in order to protect the turbine valves from high backpressures.

The above-described properties, features and advantages of this invention and the manner in which they are achieved become more clearly and distinctly comprehensible in conjunction with the following description of the exemplary embodiments which are explained in more detail in connection with the drawings.

Exemplary embodiments of the invention will be described hereinbelow with reference to the drawing. This is not to definitively show the exemplary embodiments, but rather the drawing, where conducive to clarification, is constructed in a schematized and/or slightly distorted form. With regard to additions to the teaching which is directly apparent in the drawing, reference is made to the relevant prior art.

BRIEF DESCRIPTION OF THE DRAWINGS

The single FIGURE shows a steam power plant according to the invention.

DETAILED DESCRIPTION OF INVENTION

With regard to additions to the teaching which is directly apparent in the drawing, reference is made to the relevant prior art.

The FIGURE shows a steam power plant 1 comprising a steam turbine 2 that comprises a first turbine section 2*a* and a second turbine section 2*b*. For the sake of clarity, a boiler and a generator are not shown in greater detail. Furthermore, the first turbine section 2*a* is in the form of a combined high- and intermediate-pressure steam turbine.

Live steam flows from a boiler (not shown in greater detail) via a quick-closing valve 3 and a control valve 4, fluidically connected to the quick-closing valve 3, into a steam line 5. Thus, the live steam flows first through the quick-closing valve 3, then through the control valve 4 and thence via the steam line 5 into the high-pressure section 2*c* of the first turbine section 2*a*. After flowing through the high-pressure section 2*c* of the first turbine section 2*a*, the steam flows out of the high-pressure section 2*c* (not shown), is reheated in an intermediate superheater and then flows, via an intermediate-pressure quick-closing valve 6 and intermediate-pressure control valve 7, into the intermediate-pressure section 2*d* of the first turbine section 2*a*.

After flowing through the intermediate-pressure section 2*d* of the first turbine section 2*a*, the steam finally reaches the second turbine section 2*b*, which is designed as a low-pressure turbine. The steam line that fluidically connects the first turbine section 2*a* to the second turbine section 2*b* is not shown and is termed an overflow line.

After flowing through the second turbine section 2*b*, the steam then flows into a condenser 8, where it condenses to water.

For the sake of clarity, part of a seal steam system 9 is shown with the steam turbine 2. The steam flowing into the quick-closing valve 3 and the control valve 4 is characterized by a relatively high temperature and a high pressure. The steam flowing into the intermediate-pressure quick-closing valve 6 and the intermediate-pressure control valve 7 is characterized by a high temperature with a pressure that is lower than in the previous case.

The valves 3, 4, 6 and 7 comprise a valve housing and a valve stem that moves a valve cone. A movement of the valve stem with the valve cone regulates the flow of steam through the valve and thus the quantity of steam flowing through the steam line 5. Each of the valves 3, 4, 6, 7 comprises a control unit 10 that is designed to control the valve stem.

The valve-stem leakage steam flows out of the quick-closing valve 3 via a first valve-stem leakage steam line 11. Equally, valve-stem leakage steam flows out of the intermediate-pressure quick-closing valve 6, via a second valve-stem leakage steam line 12, into a common, third valve-stem leakage steam line 13. A fitting 14*a* is arranged in the third valve-stem leakage steam line 13. After the steam has flowed through the fitting 14*a*, the valve-stem leakage steam passes, via a fourth valve-stem leakage steam line 15, into a valve-stem leakage steam collector 16.

The valve-stem leakage steam from the control valve 4 and the intermediate-pressure control valve 7 is formed in a similar manner to this. The valve-stem leakage steam from the control valve 4 is guided via a fifth valve-stem leakage steam line 17. The valve-stem leakage steam issuing from the intermediate-pressure control valve 7 enters a sixth valve-stem leakage steam line 18. The fifth valve-stem leakage steam line 17 and the sixth valve-stem leakage steam line 18 discharge into a common, seventh valve-stem leakage steam line 19 in which there is arranged a fitting 14*b*. After flowing through the fitting 14*b*, the leakage steam enters an eighth valve-stem leakage steam line 20 and thence, finally, the valve-stem leakage steam collector 16.

In the third valve-stem leakage steam line 13, there is arranged, in addition to the fitting 14*a*, a first safety valve 21, and in the seventh valve-stem leakage steam line 19, there is arranged, in addition to the fitting 14*b*, a second safety valve 22.

The fittings 14*a* and 14*b* are opened as soon as there is a flow of valve-stem leakage steam. The fittings 14*a* and 14*b* close again when there is no flow of valve-stem leakage steam.

The fittings 14*a* and 14*b* can be designed as flaps. These flaps can be controlled, respectively, by a first control unit 23*a* and a second control unit 23*b*. In that context, the first control unit 23*a* actuates the first fitting 14*a* and the second control unit 23*b* actuates the second fitting 14*b*.

In an alternative embodiment, the flap 14*a*, 14*b* can be designed as a check flap.

Furthermore, the fittings 14*a* and 14*b* can be designed as a valve.

The steam power plant 1 illustrated in the FIGURE is characterized in that the valve-stem leakage steam collector 16 is designed as a condenser 8. This may be a separator-condenser or the condenser that is fluidically connected downstream of the second turbine section 2*b*.

Although the invention has been described and illustrated in more detail by way of the preferred exemplary embodiment, the invention is not restricted by the disclosed examples and other variations can be derived herefrom by a person skilled in the art without departing from the scope of protection of the invention.

The invention claimed is:

1. A steam power plant comprising a steam turbine, a steam line that is fluidically connected to the steam turbine and is designed to convey steam, a valve that is arranged in the steam line and is designed to change a quantity of steam flowing through the steam line, the valve comprising a first outlet to which the steam line connects, and a second outlet configured to convey valve-stem leakage steam that leaks past a valve stem of the valve, a valve-stem leakage steam line connected to the second outlet, and a valve-stem leakage steam collector that is fluidically connected to the valve-stem leakage steam line, and a fitting that is arranged in the valve-stem leakage steam line, wherein the valve-stem leakage steam collector is designed as a condenser, wherein the valve-stem leakage steam is conveyed via the valve-stem leakage steam line directly from the second outlet to the condenser, and wherein the fitting is configured to open whenever a pressure of valve-stem leakage steam in the valve-stem leakage steam line upstream of the fitting is above a pressure in the condenser, thereby passing all of the valve-stem leakage steam into the condenser.

2. The steam power plant as claimed in claim 1, wherein the fitting is designed as a flap.

3. The steam power plant as claimed in claim 2, wherein the flap is designed such that it is controlled.

4. The steam power plant as claimed in claim 2, wherein the flap is designed as a check flap.

5. The steam power plant as claimed in claim 1, wherein the fitting is designed as a valve.

6. The steam power plant as claimed in claim 1, further comprising:

a safety valve arranged in the valve-stem leakage steam line.

7. A method for operating a steam power plant, wherein the steam power plant comprises:

a steam turbine, a steam line that is fluidically connected to the steam turbine and is designed to convey steam, a valve that is arranged in the steam line and is designed to change a quantity of steam flowing through the steam line, the valve comprising a first outlet to which the steam line connects, and a second outlet configured to convey valve-stem leakage steam that leaks past a valve stem of the valve, a valve-stem leakage steam line connected to the second outlet, and a valve-stem leakage steam collector that is fluidically connected to the valve-stem leakage steam line, and a fitting that is arranged in the valve-stem leakage steam line, wherein the valve-stem leakage steam collector is designed as a condenser, wherein the valve-stem leakage steam is conveyed via the valve-stem leakage steam line directly from the second outlet to the condenser, the method comprising:

opening the fitting whenever a pressure of valve-stem leakage steam in the valve-stem leakage steam line upstream of the fitting is above a pressure in the condenser to pass all of the valve-stem leakage steam to the condenser, and closing the fitting whenever the pressure of valve-stem leakage steam in the valve-stem leakage steam line upstream of the fitting is below the pressure in the condenser.

8. The method as claimed in claim 7, wherein a safety valve in the valve-stem leakage steam line opens to release more than a maximum pressure in the valve-stem leakage steam line.

9. A steam power plant, comprising:

a first flow circuit in which steam flows into a steam valve, then out the steam valve via a first valve outlet, then through a steam line to a steam turbine; and a second flow circuit in which the steam flows into the steam valve, then leaks past a valve stem and a housing of the steam valve, then flows out the steam valve via a second outlet, then through a fitting configured to open whenever a pressure of the steam at the second outlet is above a pressure in a condenser, and then directly to the condenser.

10. The steam power plant of claim 9, wherein the fitting comprises a check flap.

* * * * *